United States Patent [19]

Savio et al.

[11] 4,153,214

[45] May 8, 1979

[54] DEVICE FOR CONTROLLING THE TENSION IN THE YARN UNWINDING FROM A YARN CARRYING BODY

[75] Inventors: Ermanno Savio; Sergio Calamani; Eugenio Turri, all of Milan, Italy

[73] Assignee: Savio & C. S.p.A., Milan, Italy

[21] Appl. No.: 940,218

[22] Filed: Sep. 6, 1978

[30] Foreign Application Priority Data

Sep. 29, 1977 [IT] Italy ..... 28087 A/77

[51] Int. Cl.[2] ..... B65H 51/20; B65H 59/26

[52] U.S. Cl. ..... 242/47.01; 242/128; 242/147 R

[58] Field of Search ..... 242/47.01–47.13, 242/128, 129.8, 147 R, 149, 153, 154, 82, 83; 66/132 R; 139/452

[56] References Cited

U.S. PATENT DOCUMENTS

| | | | |
|---|---|---|---|
| 2,479,826 | 8/1949 | Frick et al. | 242/128 |
| 3,093,339 | 6/1963 | Godderidge | 242/82 |
| 3,702,176 | 11/1972 | Rosen | 242/47.01 |
| 3,759,300 | 9/1973 | Pfarrwaller | 242/47.01 X |
| 3,834,635 | 9/1974 | Pfarrwaller | 242/47.01 |
| 3,921,925 | 11/1975 | Sarfati et al. | 242/47.12 |
| 3,994,447 | 11/1976 | Sarfati et al. | 242/47.12 |
| 3,995,786 | 12/1976 | Deniega | 242/47.01 |
| 4,013,238 | 3/1977 | Calamani et al. | 242/47.01 |
| 4,068,807 | 1/1978 | Jacobsson | 242/47.01 |
| 4,106,712 | 8/1978 | Savio et al. | 242/47.01 |

*Primary Examiner*—Stanley N. Gilreath
*Attorney, Agent, or Firm*—Oblon, Fisher, Spivak, McClelland & Maier

[57] ABSTRACT

Device for controlling the tension in the yarn unwinding from a yarn carrying body, a first shaped body being fast with the latter and having a continuous series of elongated flexible hairs inwardly projecting from its outer edge, the free end of said hairs being adjacent the free edge of an annular projection extending axially of the yarn carrying body.

The device also comprises a second shaped body, coaxial with the first mentioned shaped body, having an annular projection extending therefrom, the free edge of this projection contacting said hairs at an intermediate location of the length thereof.

3 Claims, 2 Drawing Figures

Figure 1:
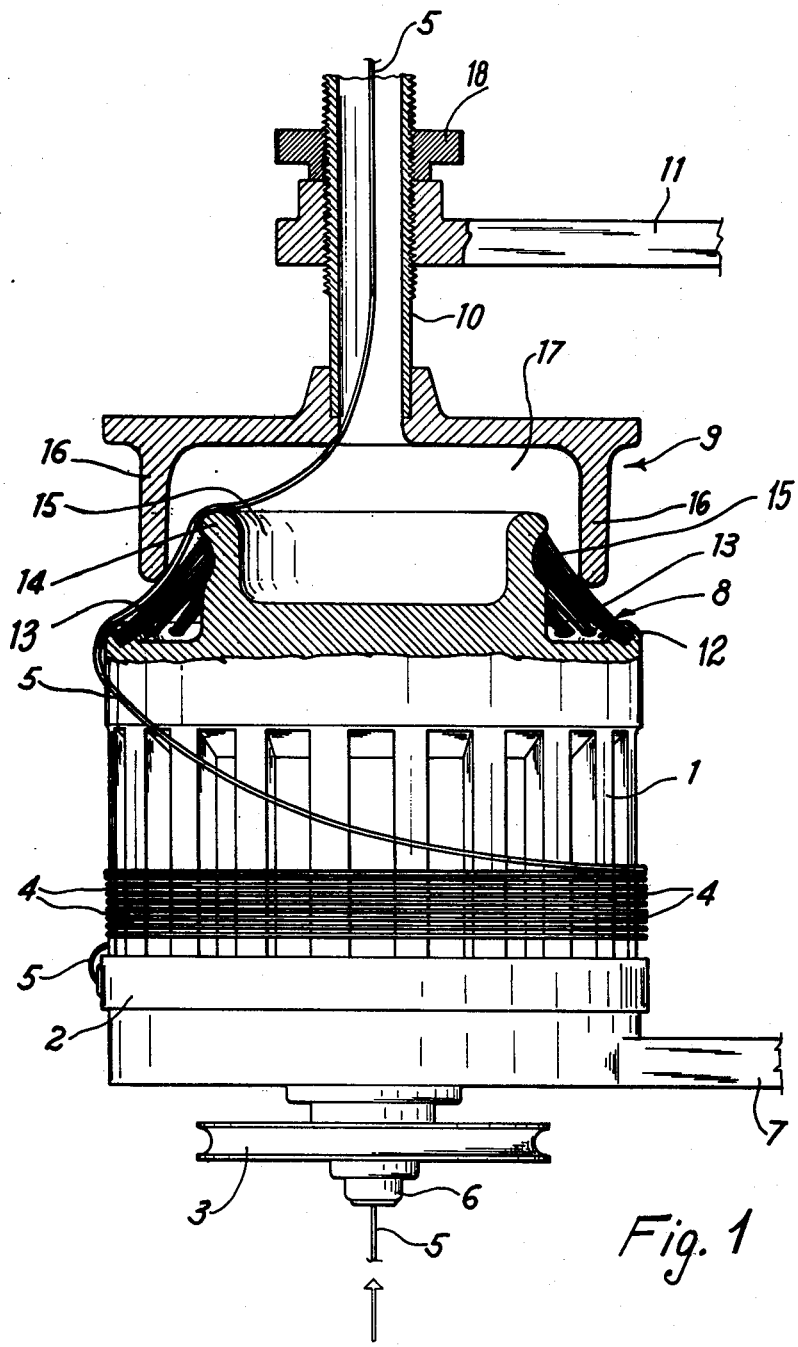

DEVICE FOR CONTROLLING THE TENSION IN THE YARN UNWINDING FROM A YARN CARRYING BODY

This invention relates to a device for controlling the tension in the yarn unwinding from a yarn supporting body, particularly from an apparatus for yarn storage and feeding thereof to using machines.

It is well known that when yarn is being unwound from yarn supporting bodies, such as bobbins or apparatus for yarn feeding to using machines, on which the yarn is wound up in the form of turns, the necessity often occurs of controlling the tension in the yarn being drawn off such yarn supporting bodies. In addition to providing for tension adjustment, a device for yarn tension control should be such as to allow for yarn passage even when the yarn has knots or general enlargements.

Many types of devices are known for controlling the yarn tension which, for example, are in the form of interfacing pan-like members that are kept pressed against one another by a spring, the yarn passing between the two pan-like members and being braked thereby. This type of device has many disadvantages in that the yarn tension control is hardly adjustable to a desired value, and particularly in that the yarn, on sliding on such pan-like members, would be inclined to deposit thereon such materials as piles, dust and dirt that tends to render the device unusable.

Other yarn braking devices, such as that disclosed in U.S. Pat. 3,702,176, comprise combs of plastics material formed of flexible fingers facing the yarn turn supporting body and below which the unwinding yarn passes and deflects said fingers, lifting the latter away from the abutting surface. Other devices comprise hairs or bristles acting upon a bell overlapping the yarn turn supporting body, which on unwinding bends or deflects such hairs or bristles moving the same way from the bell, as disclosed in U.S. Pat. No. 3,834,635. Still other devices, such as that disclosed in French Pat. No. 90,871, comprise tufts of hairs or bristles carried by a fixed ring encircling the yarn turn supporting body to which they extend and on the cylindrical surface of which the free ends of such hairs would bear. In these types of braking devices, the yarn being unwound from the yarn turn supporting body passes between a fixed surface (the cylindrical surface of the supporting body or a bell outside thereto) and the free ends of the flexible hairs. These devices suffer from the disadvantage that, particularly where multifilament yarns are used, the yarn may become bound or knotted on the free ends of the hairs, the braking action being exerted is of a fixed value and cannot be adjusted, and the free ends of said hairs tend to pull away from the yarn passing therebeneath slags and dust or fly of various nature, which would thereby accumulate on the braking device.

Further braking devices comprise somewhat elongated bristles or hairs radially projecting above the top of the yarn turn supporting body, just as described in U.S. Pat. No. 2,479,826, the unwinding yarn being intercepted by such hairs, bending the same and being thereby braked.

Devices are also known as comprising spring-loaded foils or segments acting on the yarn to brake the latter, as disclosed in U.S. Pat. No. 3,093,339.

Depending on the structure thereof, the above mentioned yarn braking devices suffer from a number of disadvantages such as, for example, that the tension thereby applied to the yarn can be only adjusted by replacing the device with a different device, although of a similar structure, that the tension imparted to the yarn varies in accordance with the yarn unwinding speed, and also that some of such devices tend to cause breakage in the yarn when the latter has knots and the yarn is being unwound at high speed.

Therefore, it is the primary object of the present invention to provide a device for controlling the tension in a yarn, which device may be used without any troubles even on multifilament yarns and does not cause any separation of slags or impurities from such yarns.

It is another object of the invention to provide a device of the above disclosed type allowing a very easy and ready adjustment in the yarn tension within wide ranges.

These and still further objects of the invention are attained by a device comprising two shaped bodies facing each other and coaxial with said yarn carrying body, the first shaped body being fast or integral with the latter, whereas the second shaped body, having an axial hole passing therethrough for the passage of the yarn which is drawn from said carrying body and the tension of which has been controlled, is supported by a fixed bracket, characterized in that the outer edge of the first shaped body has inwardly projecting therefrom a continuous series of flexible elongated hairs distributed according to a conical surface, with one end thereof fast with said edge, inclined in the direction to the second shaped body and tangentially of the yarn unwinding, the other end of said hairs being free and positioned adjacent the free end of an elongated annular projection extending axially of said first shaped body, an annular projection of an intermediate diameter between the diameters of the outer edge and annular projection of the first shaped body extending from said second shaped body to said first shaped body, under use conditions of the device the free edge of the annular projection in the second shaped body contacting said hairs at an intermediate location along the length thereof.

Figure 2:
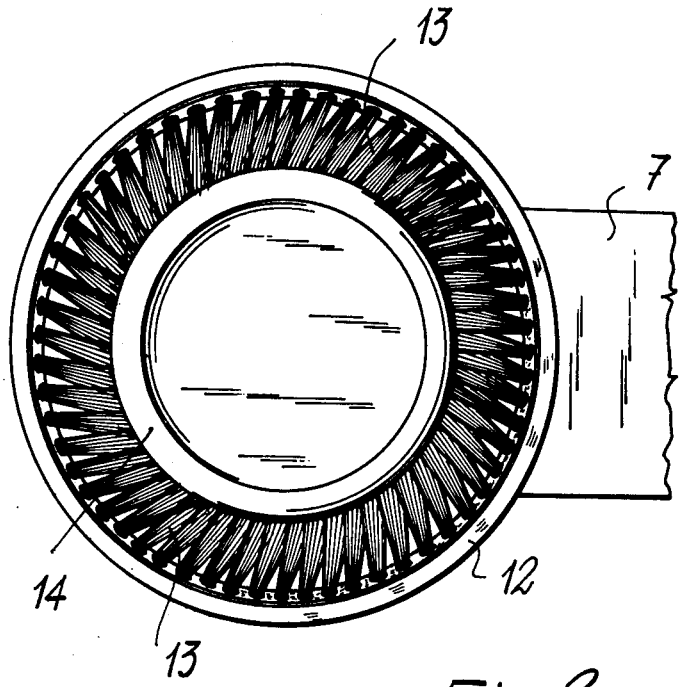

In order that the structure and features of the device according to the invention be more clearly understood, an embodiment thereof will now be described, as given by mere wy of unrestrictive example, reference being had to the accompanying drawings, in which:

FIG. 1 is a sectional view showing a device for controlling the tension in a yarn, the device being mounted on the head of a conventional yarn storing and feeding apparatus; and FIG. 2 is a top view of the device with its upper portion removed for showing the hairs forming part of the device.

Referring now to the figures of the accompanying drawings, there is shown in FIG. 1 a drum 1, at the base of which a hollow rotary arm member 2, rotably driven by a pulley 3 connected to a motor by a belt, not shown on the drawing, distributes a yarn 5 in the form of turns 4, such as a yarn 5 from a yarn bobbin passing through a hollow hub 6, the latter being fast or integral with said pulley 3 and arm member 2.

Said pulley 3, hollow hub 6, and rotary arm 2 are rotably carried on a fixed bracket 7. Drum 1 is mounted on bearings carried by hub 6 and is prevented from rotating by means of gears, as disclosed in U.S. Pat. No. 3,093,339 and No. 3,776,480, or by means of permanent magnets as disclosed in U.S. Pat. No. 3,834,635, or by means of rolling bearings as disclosed in U.S. Pat. No.

3,944,156 and No. 3,791,598. Yarn turns 4 distributed at the base of drum 1 by rotary arm 2 are upward moved as seen in the drawing by rocking or oscillating members carried on hub 6.

The feeder structure so far described is of no importance for the purposes of the present invention and has been given only to show a practical use of the yarn tension adjusting device, and is of a per se well known type. Such feeders are disclosed, for example, in U.S. Pat. Nos. 2,625,340, 3,093,339, 3,419,225, 3,702,176, 3,776,480 and 3,834,635, and in still other patents.

A device according to the present invention is for controlling the tension of yarn 5 being unwound from the upper end of drum 1. Such a device comprises a shaped body 8 applied to the top end of the feeder apparatus and a shaped body 9, coaxial with and facing said body 8 and mounted at one end of a hollow shaft 10 carried by a fixed bracket 11.

As shown in FIGS. 1 and 2, a continuous series of elongated flexible hairs 13 inwardly project from the outer edge 12 of body 8, the hairs being distributed according to a conical surface having apex to body 9. While one end of hairs 13 is fast with edge 12 of body 8, the other end of said hairs is free and extends adjacent and below free edge 14, outwardly bent over, of an elongated annular projection 15 axially extending from body 8.

Shaped body 9 (FIG. 1) comprises an annular projection 16 extending towards body 8 from a disc 17 integral with said hollow shaft 10. This annular projection 16 is of an intermediate diameter between the diameters of edge 12 and annular projection 14 of body 8.

An axial hole passes through disc 17 and is coincident with the axis of hollow shaft 10, on the outer face of which a thread is formed for meshing with the thread in a hole of said fixed bracket 11 so that, by rotating said shaft 10 about its own axis, body 9 can be moved close to or away from body 8. After being positioned as desired, body 9 can be steadily clamped by means of a ring nut 18 screwed down on shaft 10.

Under the device use conditions, as shown in FIG. 1, the free edge of annular projection 16 contacts and exerts a slight pressure on hairs 13. Thus, yarn 5 being unwound from drum 1 and drawn through the cavity of tubular shaft 10 is slightly pressed by projection 16 on hairs 13 in an intermediate section of the length thereof and is braked with a force depending on the position of body 9 relative to body 8, which force can be easily and readily varied by axially displacing said body 9.

The yarn unwinding from the drum slides all about edge 12, that is its movement in the section between edge 12 and edge 14 of annular projection 15 has a component of axial movement and a tangential component. It is important to note that hairs 13 are not directed from edge 12 to the drum axis, but are inclined (FIG. 2) in the tangential unwinding direction of the yarn, so that each individual location of the yarn contacting a specific hair adjacent edge 12 moves towards the drum axis, while sliding along the hair.

Thus, the yarn being unwound from the drum never transverses the hairs, but simply slides along the same without contacting the free ends thereof that are protected by the edge 14 of projection 15, and this in addition to yarn 5 circularly sliding on the free edge of annular projection 16 and on edge 14 gives the braking device a self-cleaning feature, since the yarn tends to remove any residual possibly left by a preceding yarn section.

What we claim is:

1. A device for controlling the tension in the yarn unwinding from a yarn carrying body, particularly from an apparatus for storing the yarn and feeding it to using machines, comprising two shaped bodies facing each other and coaxial with said yarn carrying body, the first shaped body being fast with the latter, while the second shaped body, having an axial hole passing therethrough for the passage of the yarn drawn from said carrying body and the tension of which has been controlled, is carried by a fixed bracket, wherein the outer edge of said first shaped body has a continuous series of elongated flexible hairs inwardly projecting therefrom and distributed according to a conical surface, with one end thereof fast with said edge, and inclined in a direction towards the second shaped body and in the tangential unwinding direction of the yarn, the other end of said hairs being free and positioned adjacent the free edge of an elongated annular projection axially extending from the first shaped body, an annular projection of an intermediate diameter between the diameters of the outer edge and annular projection of the first shaped body extending from the second shaped body to the first shaped body, under the device use conditions the free edge of the annular projection of the second shaped body contacting said hairs at an intermediate location of the length thereof.

2. A device according to claim 1, wherein the free edge of said annular projection of the first shaped body is outwardly bent over beyond the free end of said hairs.

3. A device according to claim 1 or 2, wherein said second shaped body is carried from said fixed bracket by members provided with means for varying and controlling the axial positioning of the body.

* * * * *